US006477709B1

(12) United States Patent
Kawana

(10) Patent No.: US 6,477,709 B1
(45) Date of Patent: Nov. 12, 2002

(54) BUOYANCY COMPENSATOR JACKET FOR DIVER

(75) Inventor: Kenji Kawana, Tokyo (JP)

(73) Assignee: Tabata Co., Ltd., Ehime-ken (JP)

( * ) Notice: Subject to any disclaimer, the term of this patent is extended or adjusted under 35 U.S.C. 154(b) by 88 days.

(21) Appl. No.: 09/782,395

(22) Filed: Feb. 13, 2001

(30) Foreign Application Priority Data

Feb. 17, 2000 (JP) ..... 2000-039957

(51) Int. Cl.[7] ..... B63C 11/04; A61M 15/00

(52) U.S. Cl. ..... 2/2.15; 2/2.16; 2/2.17; 405/186

(58) Field of Search ..... 2/2.15, 2.16, 2.17; 405/186

(56) References Cited

U.S. PATENT DOCUMENTS 4,523,914 A * 6/1985 Faulconer et al. ..... 441/108
4,752,263 A * 6/1988 Pritchard et al. ..... 441/88
4,810,134 A * 3/1989 Eaulconer et al. ..... 405/186
4,887,932 A * 12/1989 Toth ..... 405/186
5,346,419 A * 9/1994 Kaiser ..... 441/96
5,378,084 A * 1/1995 Walters et al. ..... 405/186
5,403,123 A * 4/1995 Walters ..... 405/286
5,441,367 A * 8/1995 Toth ..... 405/186
5,562,513 A * 10/1996 Kaiser ..... 441/111
5,620,282 A * 4/1997 Stinton ..... 405/186
5,860,769 A * 1/1999 Seligman ..... 405/186

FOREIGN PATENT DOCUMENTS

JP 5-112291 5/1993
WO WO 88/05670 * 8/1988 ..... A61M/15/00

* cited by examiner

*Primary Examiner*—John J. Calvert
*Assistant Examiner*—Robert H. Muromoto, Jr.
(74) *Attorney, Agent, or Firm*—Baker & Daniels

(57) ABSTRACT

A buoyancy compensator jacket includes a cushion pad lying inside a backplate of the jacket and the cushion pad is water-impervious on its surface and formed in a plurality of regions with dome-shaped swellings being convex toward the back of a wearer. The jacket including such cushion pad can prevent water permeation into the pad from occurring and a weight of the pad from increasing due to the water permeation during diving.

7 Claims, 6 Drawing Sheets

BUOYANCY COMPENSATOR JACKET FOR DIVER

BACKGROUND OF THE INVENTION

This invention relates to a buoyancy compensator jacket for diver.

Japanese Patent Application Publication No. 1993-112291A describes a buoyancy compensator jacket, which is provided on its back with holder means serving to fix an air tank thereto. This holder means comprise a frame member equivalent to a backplate and a sheet member made of woven fabric adapted to be would around the air tank and to fix this to the frame member. The frame member is covered with a cushion pad from the inner side of a bladder jacket in order to protect the wearer's back from uncomfortable irritation exerted by the frame member fixing the air tank to the jacket's back.

The cushion pad used in the known buoyancy compensator jacket is usually made of foamed material such as foamed urethane, particularly open cell material. The cushion pad is preferable so far as its elasticity is concerned. However, a considerable amount of water permeates the cells and, after diving, a weight of the bladder jacket correspondingly increases, making it difficult to walk.

SUMMARY OF THE INVENTION

It is an object of this invention to provide a buoyancy compensator jacket that is designed so that an initial weight of the cushion pad may be maintained even after diving.

According to this invention, there is provided a buoyancy compensator jacket for diving comprising a bladder jacket into which the air for buoyancy compensation can be introduced, a backplate mounted on a rear side of the bladder jacket provided with means for securing an air tank thereto, a cushion pad mounted on any one of the bladder jacket and the backplate so as to lie between the back of a wearer and the backplate.

The cushion pad is made of flexible elastic material which is water-impervious on a surface thereof and formed on a plurality of regions thereof with dome-shaped swellings which are convex toward the back of the wearer.

In the buoyancy compensator jacket according to this invention, the cushion pad lying inside the backplate and destined to be pressed against the diver's back is made of the elastic member of closed cell foam type or substantially non-cellular type which is water-impervious at least on its external surface. Accordingly, there is no anxiety that water permeation into the cushion pad might occur as the wearer dives and a weight of the cushion pad might increase after diving as the conventional cushion pad has often experienced.

The unique arrangement according to this invention such that bosses formed, for example, on the cushion pad are engaged with respective through-holes formed in the backplate as the bosses are elastically deformed advantageously facilitates the cushion pad and the backplate to be assembled together.

DETAILED DESCRIPTION OF THE PREFERRED EMBODIMENTS

Details of a buoyancy compensator jacket for diving according to this invention will be more fully understood from the description given hereunder with reference to the accompanying drawings.

Figure 1:
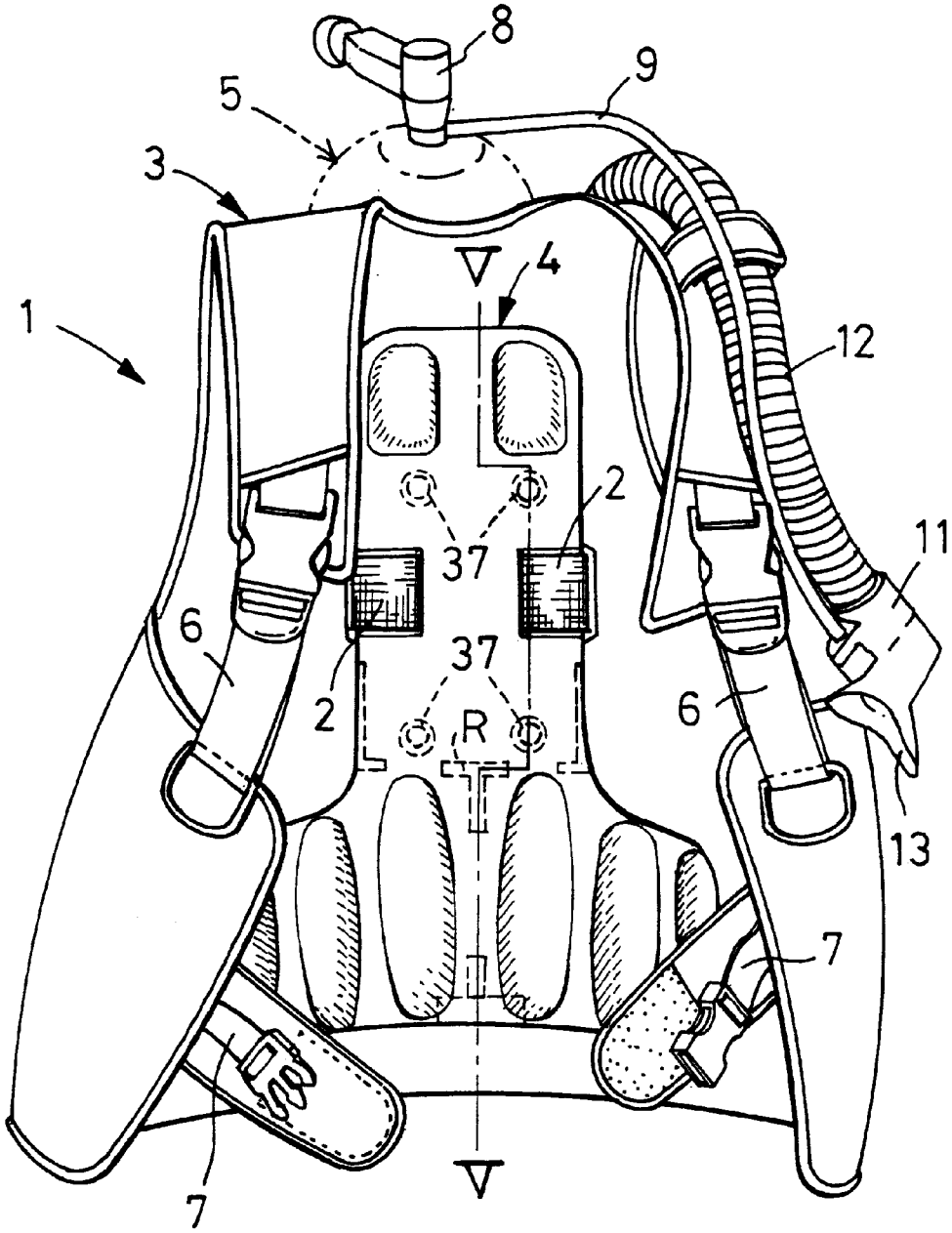
FIG. 1 is a front view of a buoyancy compensator jacket according to this invention.
Figure 2:
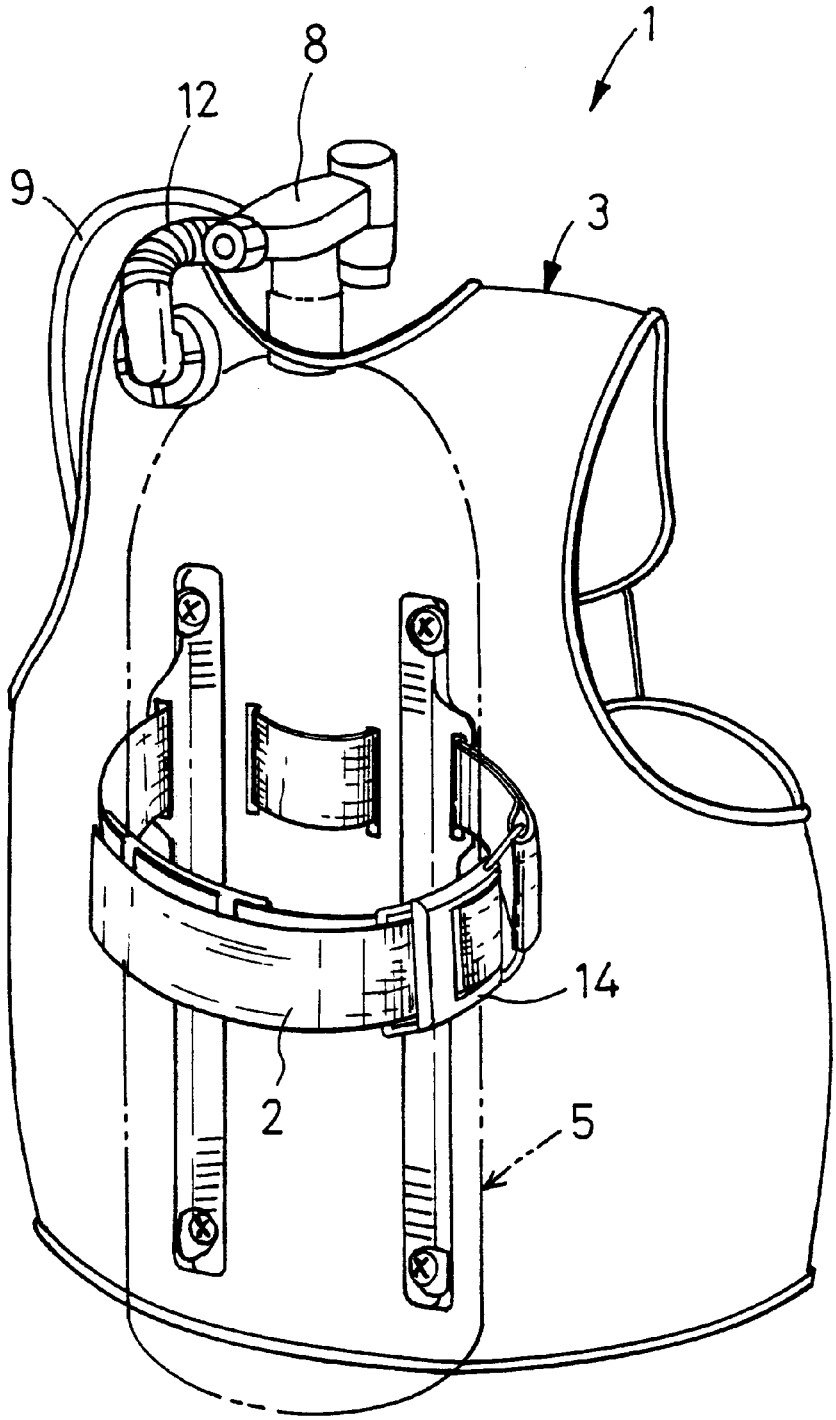
FIG. 2 is a perspective view of the buoyancy compensator jacket as viewed from its rear side.

FIGS. 1 and 2 are front and rear views of a buoyancy compensator jacket 1, respectively, in which an air tank 5 is cylindrical and mounted on the jacket 1 as indicated by chain lines.

The buoyancy compensator jacket 1 includes a bladder jacket 3 into which the buoyancy compensating air can be introduced, an air tank strap 2 and a cushion pad 4. A diver can wear the jacket 3 with a shoulder strap 6 as well as a waist belt 7 having been length-adjusted. The air tank 5 is provided on its top with a first stage 8 from which a regulator hose 9 extends to a second stage 11 from which, in turn, an inflation hose 12 extends to a rear side of the jacket 3. A mouthpiece 13 is mounted on the second stage 11. The air tank strap 2 extends along the outer side, then along the inner side and again along the inner side of the rear body of the jacket 3 and it longitudinal opposite ends are connected by means of a buckle 14 in a length-adjustable manner. The buckle 14 may be fastened on the air tank strap 2 to fix the air tank 5 to the jacket 3.

Figure 3:
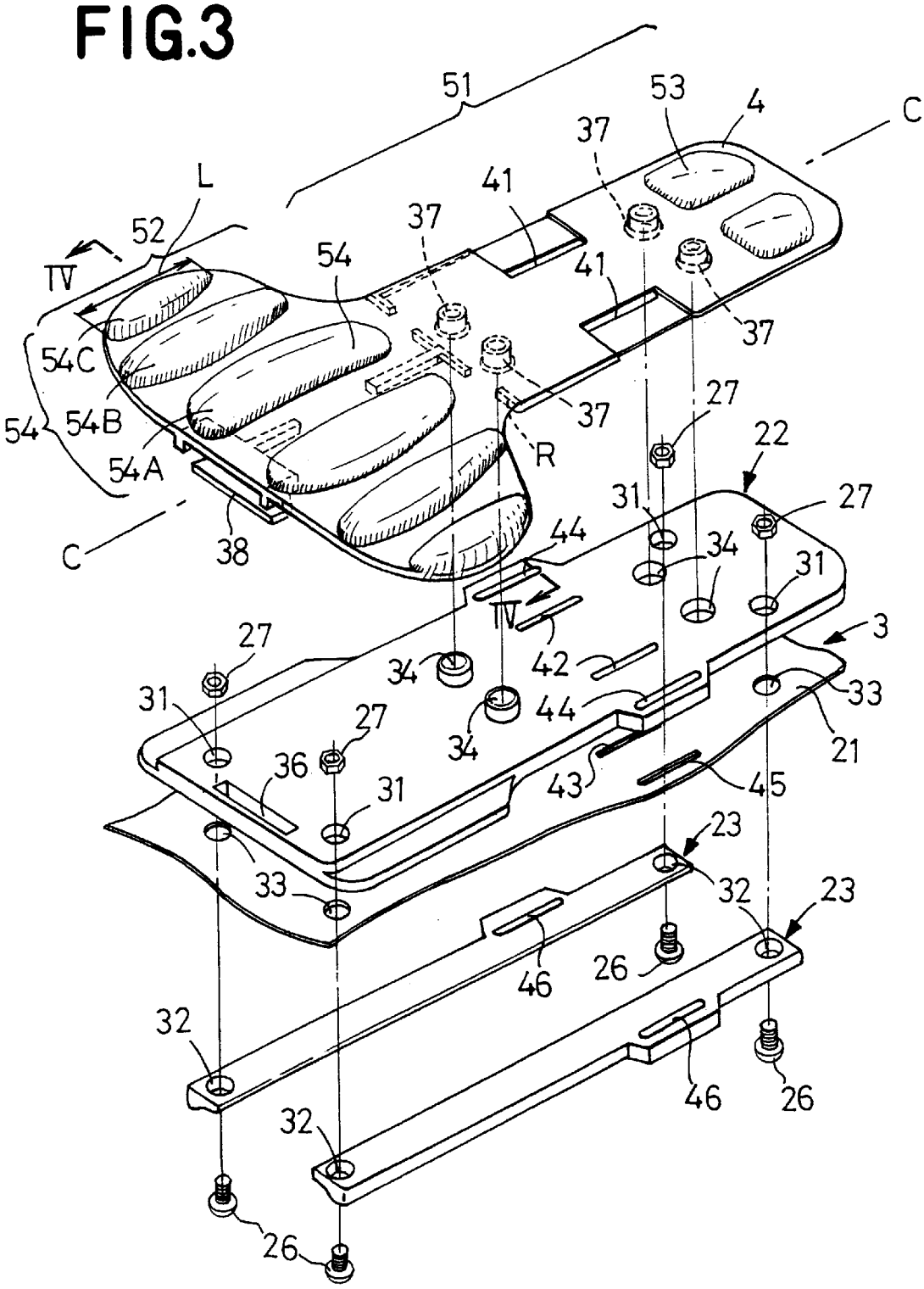
FIG. 3 is a fragmentary exploded perspective view of the buoyancy compensator jacket.

FIG. 3 is a fragmentary exploded perspective view of the buoyancy compensator jacket 1 in which the strap 2 is not illustrated. As shown, a backplate or harness 22 and the cushion pad 4 extend inside a fabric layer 21 (i.e., above the fabric layer 21 as viewed in FIG. 3) and a pair of rod members 23 extend outside the fabric layer 21 (i.e., below the fabric layer 21 as viewed in FIG. 3). The backplate 22 and the rod members 23 are assembled together by means of four sets of bolts 26 and nuts 27 with the fabric layer 21 therebetween and secured to the fabric layer 21, i.e., the jacket 3 (See FIG. 2 also). Upon achievement of securing the backplate 22 and the rod members 23 to the jacket 3, the bolts 26 extend through respective through-holes 31, 32, 33 formed in the backplate 22, the rod members 23 and the fabric layer 21. The backplate 22 is formed in its middle region with four through-holes 34 and in its lower end (i.e., the vicinity of its left end as viewed in FIG. 3). The cushion pad 4 is formed on its lower surface with four cylindrical bosses 37 projecting downward and one L-shaped boss 38. The cushion pad 4 may be placed upon the backplate 22 which has already been secured to the jacket 3 to engage the cylindrical bosses 37 with the respective through-holes 34, on one hand, and to engage the L-shaped boss 38 with the through-hole 36. In this manner, the pad 4 is assembled with the plate 22, so the pad 4, the plate 22, the fabric layer 21 and the rod members 23 are integrally placed upon one another in the vertical direction.

In the assembly of the pad 4, the plate 22 and the fabric layer 21 placed upon one another, first rectangular slots 41 of the pad 4, second rectangular slots 42 of the plate 22 and third rectangular slots 43 of the fabric layer 21 are aligned one with another. In the assembly of the plate 22, the fabric layer 21 and the rod members 23 placed upon one another, fourth rectangular slots 44 of the plate 22, fifth rectangular slots 45 of the fabric layer 21 and sixth rectangular slots 46 of the rod members 23 are aligned with one another. The air tank strap 2 is inserted successively into these rectangular slots until the state shown in FIGS. 1 and 2 is established.

The cushion pad 4 is symmetrical about a center line C—C bisecting a width of the jacket 3 on its rear body and comprises an upper portion 51 extending along the center line C—C vertically of the jacket 3 to cover the plate 22 and a lower portion 52 extending circumferentially of the jacket 3, i.e., orthogonally to the center line C—C. The upper portion 51 is formed with a first pair of dome-shaped swellings 53 projecting toward a jacket wearer's back on both sides of the center line C—C, respectively. Similarly, the lower portion 52 is formed on each side of the center line C—C with three second swellings 54, specifically, 54A, 54B, 54C arranged circumferentially of the wearer's torso. These second swellings 54A, 54B, 54C have their respective dimensions as measured in the direction of the center line C—C progressively reducing as they go away from the center line C—C.

Figure 4:
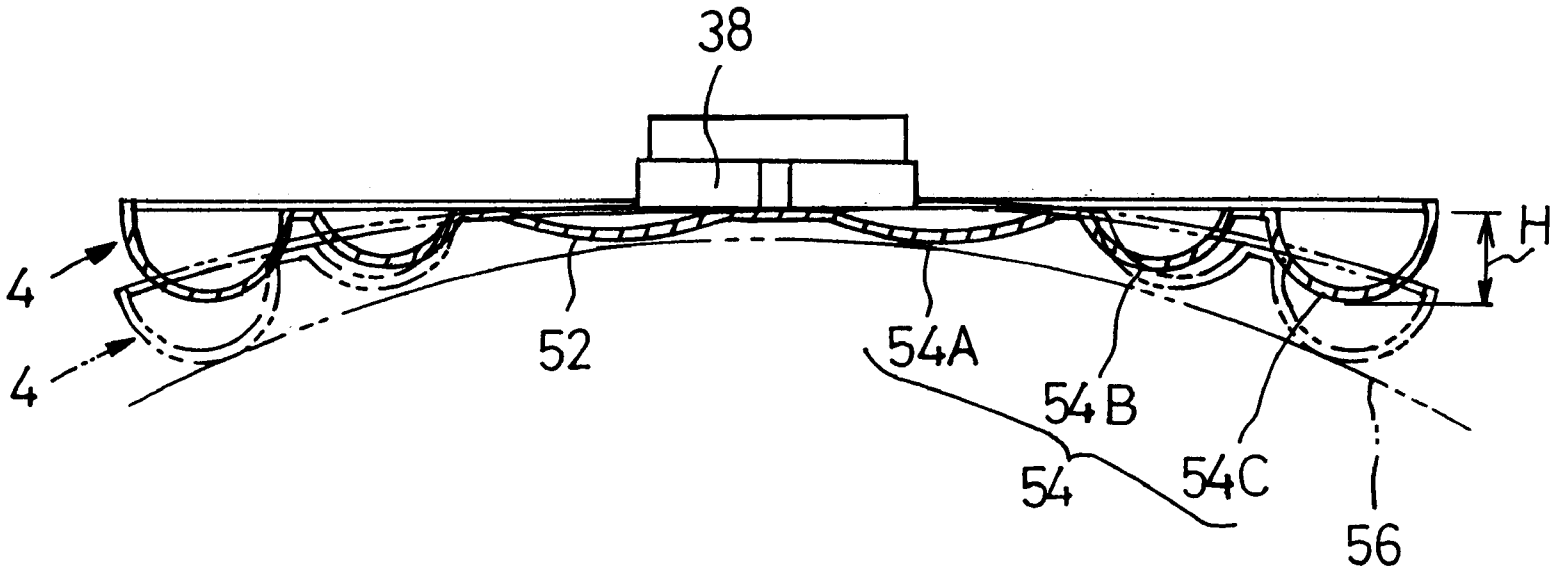
FIG. 4 is a sectional view taken along line IV—IV in FIG. 3.

FIG. 4 is a sectional view taken along line IV—IV in FIG. 3, in which chain lines indicate an outline defined by the back of the diver wearing the buoyancy compensator jacket 1 and the cushion pad 4 curved in contact with the outline 56. Except the bosses 37, 38 and ribs R (See FIGS. 1 and 3), the cushion pad 4 has a substantially uniform thickness and partially depressed at the second swellings 54 so as to be convex toward the outline 56 of the wearer's back in the form of domes. Similarly to the second swellings 54, the first pair of swellings 53 are dome-shaped. Such cushion pad 4 is made of flexible elastic material such as plastic elastomer so that both the first swellings 53 and the second swellings 54 may be elastically deformed as these swellings 53, 54 are pressed against the diver's back to provide a desired cushioning effect. In this way, it is not apprehended that the back plate 22 might be uncomfortably pressed against the diver's back. To improve the cushioning effect, the cushion pad 4 according to this embodiment adopts an arrangement such that the second swellings 54A, 54B, 54C have their respective dimensions as measured in the direction of the center line C—C progressively reduced as they go away from the center line C—C (See FIG. 3). Also to improve the cushioning effect, the second swellings 54 are formed so that their heights H from their peripheries progressively increased as they go away from the center line C—C.

For such cushion pad 4, it is important that at least its outer surface should be water-impervious so that water permeation into the pad 4 may not occur and, to meet such requirement, substantially non-porous or closed cell foamed plastic elastomer, rubber or the like is used as the flexible elastic material to form such cushion pad 4.

Figure 5:
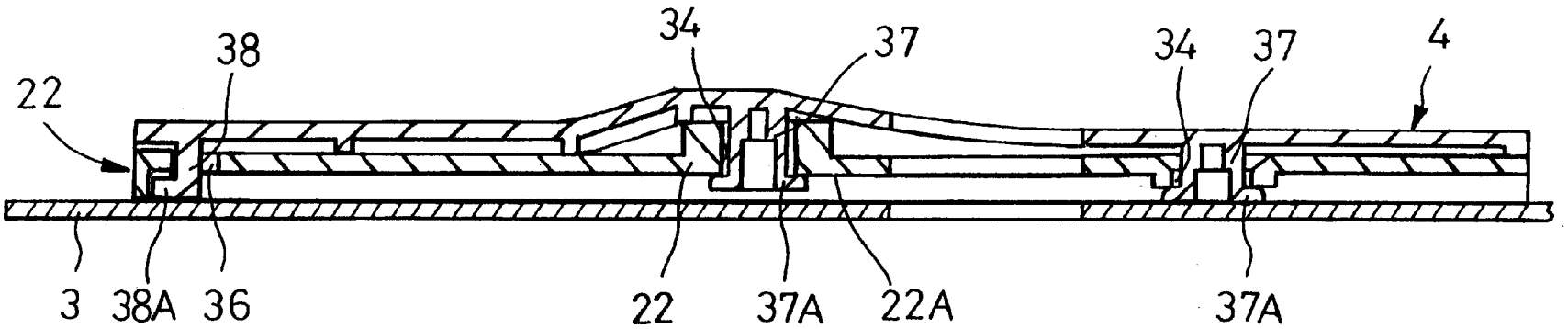
FIG. 5 is a sectional view taken along line V—V in FIG. 1.

FIG. 5 is a sectional view taken along line V—V in FIG. 1. In the cushion pad 4, the cylindrical bosses 37 are engaged with the respective through-holes 34 of the backplate 22 as the cylindrical bosses 37 are elastically deformed and simultaneously the diameter-enlarged portions 37A of the respective bosses 37 are pressed against the outer surface 22*a* of the backplate 22 around the respective through-holes 34 so that the bosses 37 may be reliably prevented from falling off from the respective through-holes 34. Similarly, the L-shaped boss 38 is engaged with the through-hole 36 of the backplate 22 as this L-shaped boss 38 is elastically deformed and the leg portion 38A of this L-shape defining a distal end of this boss 38 is pressed against the outer surface 22A of the backplate 22.

Figure 6:
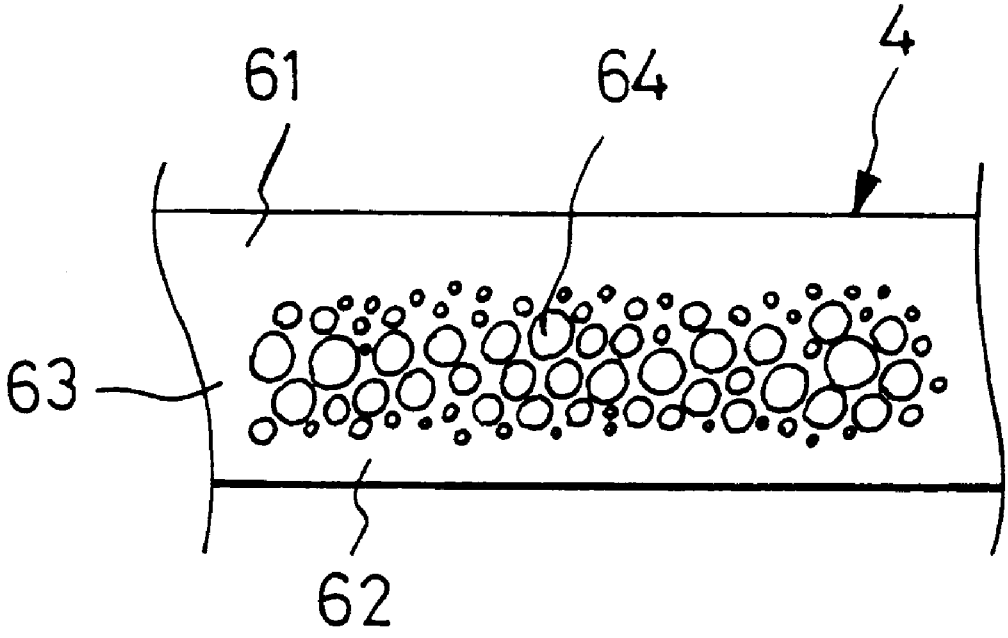
FIG. 6 is a fragmentary sectional view of a cushion pad.

FIG. 6 is a fragmentary sectional view of the cushion pad 4 having a construction differing from that of the cushion pad 4 shown in FIG. 5. The pad 4 according to this embodiment also is made of the flexible elastic member but different from that shown in FIG. 5 in that, as viewed in its section, the pad 4 comprises skin layers 61, 62 defining inner and outer surfaces of the pad 4 and a core layer 63 disposed between these two skin layer 61, 62. The skin layers 61, 62 are substantially non-cellular and prevent water permeation into the core layer 63 which has, in turn, a plurality of closed cells contributing to the light weight cushion pad 4.

It is possible without departing from the scope of this invention to secure the cushion pad 4 to the backplate 22 by forming the swellings on the backplate 22, instead of on the cushion pad 4 as in the illustrated embodiment so that these swellings may be engaged with respective depressions form in the cushion pad 4 as the cushion pad 4 is elastically deformed.

What is claimed is:

1. A buoyancy compensator jacket for diving comprising:

a bladder jacket into which the air for buoyancy compensation can be introduced;

a backplate mounted on a rear side of said bladder jacket and provided with means for securing an air tank thereto; and a cushion pad mounted on any one of said bladder jacket and said backplate so as to lie between the back of a wearer and said backplate, said cushion pad being made of flexible elastic material which is water-impervious on a surface thereof and formed on a plurality of regions thereof with dome-shaped swellings which are convex toward the back of the wearer.

2. The buoyancy compensator jacket according to claim 1, wherein a plurality of said regions are symmetrical about a center line bisecting a width of said bladder jacket.

3. The buoyancy compensator jacket according to claim 1, wherein a plurality of said regions are arranged in a line circumferentially of said bladder jacket and have heights thereof which progressively increase as said regions are spaced further away from a center line of said bladder jacket.

4. The buoyancy compensator jacket according to claim 1, wherein said cushion pad and said backplate are opposed to and in contact with each other, one of which is formed with bosses projecting toward the other and said other is formed with depressions adapted to receive said bosses so that the bosses and depressions are engaged with one another under an elastic deformation of said cushion pad.

5. The buoyancy compensator jacket according to claim 1, wherein said cushion pad comprises a flexible elastic material having substantially no cells.

6. The buoyancy compensator jacket according to claim 1, wherein said cushion pad comprises a flexible elastic material having closed cells.

7. The buoyancy compensator jacket according to claim 1, wherein said cushion pad comprises a skin layer and a core layer, said skin layer being substantially non-cellular and water-impervious and said core layer having a plurality of cells.

* * * * *